US006651728B1

(12) United States Patent
Graham

(10) Patent No.: US 6,651,728 B1
(45) Date of Patent: Nov. 25, 2003

(54) CASTING ARTICLES

(75) Inventor: Lawrence D. Graham, Chagrin Falls, OH (US)

(73) Assignee: PCC Airfoils, Inc., Cleveland, OH (US)

( * ) Notice: Subject to any disclaimer, the term of this patent is extended or adjusted under 35 U.S.C. 154(b) by 0 days.

(21) Appl. No.: 10/188,794

(22) Filed: Jul. 2, 2002

(51) Int. Cl.[7] ..... B22D 27/04

(52) U.S. Cl. ..... 164/122.1; 164/122.2; 164/338.1

(58) Field of Search ..... 164/122.1, 122.2, 164/338.1, 348, 129, 322, 323

(56) References Cited

U.S. PATENT DOCUMENTS

| | | | |
|---|---|---|---|
| 3,714,977 A | 2/1973 | Terkelsen | |
| 3,810,504 A | 5/1974 | Piwonka | |
| 4,108,236 A | 8/1978 | Salkeld | |
| 4,712,604 A | 12/1987 | Sawyer | |
| 4,763,716 A | 8/1988 | Graham et al. | |
| 4,773,467 A | 9/1988 | Graham et al. | |
| 4,774,992 A | 10/1988 | George | |
| 4,819,709 A | 4/1989 | Lallement | |
| 5,275,228 A | 1/1994 | Wortmann et al. | |
| 5,607,007 A | 3/1997 | Chandley | |
| 5,778,961 A | 7/1998 | Hugo et al. | |
| 6,276,432 B1 | 8/2001 | Thompson et al. | |
| 6,523,599 B1 * | 2/2003 | Balliel | 164/338.1 |

FOREIGN PATENT DOCUMENTS

| | | |
|---|---|---|
| JP | 54-106031 | 8/1979 |

* cited by examiner

*Primary Examiner*—Kuang Y. Lin
(74) *Attorney, Agent, or Firm*—Tarolli, Sundheim, Covell & Tummino L.L.P.

(57) ABSTRACT

A method of casting metal articles includes providing an array of article molds. The article molds are filled with molten metal. The molten metal is solidified in the article molds. During solidification of the molten metal, a plurality of solidification control elements function as heat sinks and radiation baffles. The solidification control elements are disposed between the article molds as the molten metal solidifies.

49 Claims, 4 Drawing Sheets

CASTING ARTICLES

BACKGROUND OF THE INVENTION

The present invention relates to a new improved method and apparatus for use in casting a plurality of metal articles.

A known method of casting metal articles includes providing a plurality of article molds which are disposed in an annular array. The annular array of article molds is supported on a ring-shaped chill or cooling plate. The article molds are positioned in a heating chamber of a furnace and filled with molten metal. After the article molds have been filled with molten metal, they are removed from the heating chamber. A cylindrical heat sink moves into a central portion of the annular array of article molds as they are removed from the heating chamber. This method of casting articles is disclosed in U.S. Pat. Nos. 3,810,504 and 5,778,961.

Radiation baffles have been utilized in association with the casting of metal articles in an annular array of article molds. Generally speaking, these baffles have been utilized to prevent the transmission of heat from a heating chamber of the furnace assembly during withdrawal of the annular array of article molds from the furnace assembly. The use of radiation baffles for this purpose is disclosed in U.S. Pat. Nos. 4,763,716; 4,773,467; and 4,774,992.

SUMMARY OF THE INVENTION

The present invention provides a new and improved method and apparatus for use in casting a plurality of metal articles. The method includes filling article molds with molten metal. The molten metal may be solidified in the article molds with a plurality of solidification control elements extending between a peripheral portion of an array of article molds and a central portion of the array of article molds.

The solidification control elements may function as heat sinks and/or radiation baffles. The solidification control elements may have upper end portions which are maintained adjacent to solidification fronts in the article molds during solidification of molten metal in the article molds. The solidification control elements may extend through passages in a chill plate during at least a portion of the solidification of molten metal.

It is contemplated that various features of the present invention may be utilized separately or in combination with other features of the invention. Alternatively, each of the various features of the present invention may be used in association with known prior art features.

BRIEF DESCRIPTION OF THE DRAWINGS

The foregoing and other features of the present invention will become more apparent upon consideration of the following description taken in conjunction with the accompanying drawings wherein.

DESCRIPTION OF ONE SPECIFIC PREFERRED EMBODIMENT OF THE INVENTION

General Description

Figure 1:
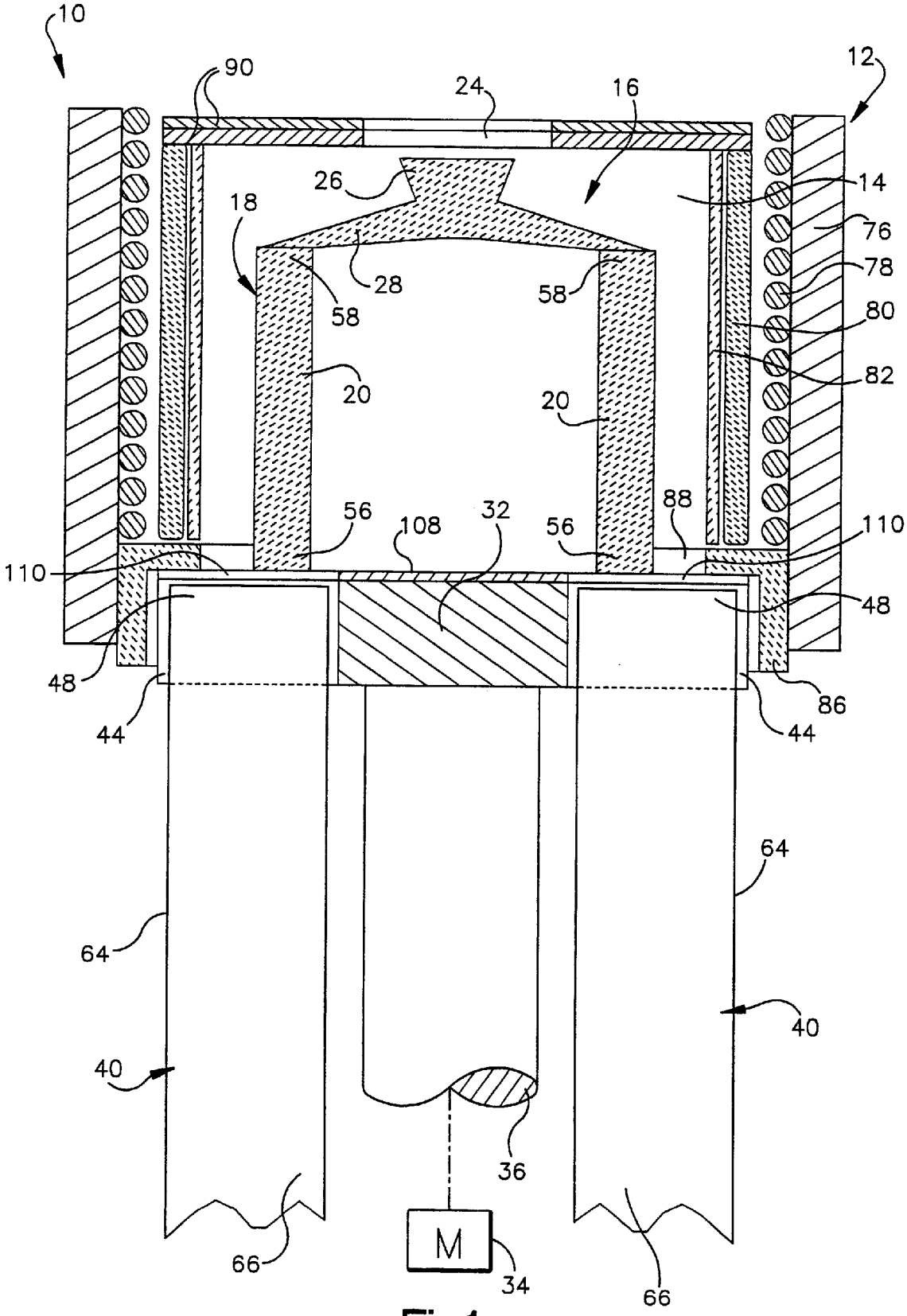
FIG. 1 Is a fragmentary schematic illustration depicting the relationship between a mold structure, a furnace assembly, a chill plate, and a plurality of solidification control elements when the mold structure is disposed in a heating chamber of the furnace assembly.

An improved apparatus 10 (FIG. 1) for use in casting metal articles includes a furnace assembly 12. The furnace assembly 12 has a cylindrical heating chamber 14 in which a mold structure 16 is disposed (FIG. 1). Molten metal is poured into the mold structure 16 while it is in the heating chamber 14.

The mold structure 16 includes an array 18 of article molds 20. The article molds 20 are disposed in an annular array having a central axis which is coincident with a central axis of the mold structure 16. However, it should be understood that the article molds 20 could be disposed in an array 18 having a configuration other than the annular configuration of the mold structure 16. Although only two article molds illustrated schematically in FIG. 1, it should be understood that the array 18 of article molds could contain any desired number of article molds. Any desired number of article molds 20 may be provided in the mold structure 16 in an array having any desired configuration. The mold structure 16 may have any one of many known constructions, including the construction disclosed in U.S. Pat. Nos. 4,667,728 and 3,714,977.

The mold structure 16 is utilized to cast turbine engine components. The turbine engine components cast in the article molds 20 may have any desired crystallographic structure, including an equiaxed, columnar grain, or single crystal structure. The articles cast in the molds 20 may be formed of a nickel-chrome superalloy. However, it should be understood that the mold structure 16 may be utilized to cast many different articles having many different constructions. The articles cast in the mold structure 16 may be formed of metals other than a nickel-chrome-superalloy. For example, the articles cast in the mold structure 16 may be formed of titanium.

When articles, such as turbine engine blades or vanes, are to be cast in the mold structure 16, molten metal is poured through a circular opening 24 in the furnace assembly 12. The molten metal is poured into a generally conical pour cup 26 of the mold structure 16. The molten metal flows from the pour cup 26 of the mold structure 16 through radially extending runners in a gating system 28. The gating system 28 connects the pour cup 26 in fluid communication with mold cavities in the article molds 20. The mold cavities in the article molds 20 have configurations corresponding to the desired configurations of the articles to be cast. It should be understood that the article molds 20 may be used to cast many different articles having many different configurations.

After the mold structure 16 has been filled with molten metal, a circular chill plate 32 is lowered to withdraw the mold structure from the heating chamber 14 of the furnace assembly 12. However, the mold structure 16 may be withdrawn from the furnace assembly 12 in a different manner if desired. For example, the mold structure 16 may be suspended from above and the suspended mold structure lowered from the furnace assembly 12. Alternatively the furnace assembly 12 may be either raised or lowered relative to the mold structure 16.

To lower the chill plate 32, a motor 34 connected with a support post 36 is operated to move the support post 36 and chill plate 32 downward (as viewed in FIG. 1) away from the furnace assembly 12. As this occurs, the mold structure 16 moves from the position illustrated in FIG. 1 through the partially withdrawn position illustrated in FIG. 2 to a fully withdrawn position in which the mold structure is disposed below (as viewed in FIG. 2) the furnace assembly 12.

As the mold structure 16 is withdrawn from the furnace assembly 12, the molten metal solidifies in the article molds 20. The manner which the mold structure 16 is withdrawn from the furnace assembly 12 and the structure of the furnace assembly may be similar to that disclosed in U.S. Pat. No. 5,046,547. However, it should be understood that the furnace assembly could have a different construction if desired.

In accordance with a feature of the present invention, a plurality of solidification control elements 40 (FIGS. 1–3) are provided. The solidification control elements 40 extend through passages 44 (FIGS. 1 and 2) formed in the chill plate 32. When the mold structure 16 is disposed in the furnace assembly 12 (FIG. 1), the solidification control elements are below the mold structure and the array 18 of article molds 20. As the mold structure 16 is withdrawn from the furnace assembly 12 (FIG. 2), the solidification control elements 40 move into positions between adjacent article molds 20 in the manner illustrated schematically in FIG. 3.

The solidification control elements 40 (FIG. 1) have upper end portions 48 which are maintained adjacent to solidification fronts between molten and solid metal in the article molds 20 during withdrawal of the mold structure 16 from the furnace assembly 12. Thus, upon initiation of withdrawal of the mold structure 16 from the furnace assembly 12, article mold cavities 52 (FIG. 3) in the article molds 20 are filled with molten metal. As the mold structure 16 is withdrawn from the furnace assembly, the molten metal solidifies upward from lower end portions 56 (FIG. 1) of the article molds 20 to upper end portions 58 of the article molds 20.

As solidification of molten metal occurs in each article mold cavity 52 in each article mold 20, the metal solidifies at a solidification front which separates solid metal at the lower portion of the article mold cavity 52 from molten metal in the upper portion of the article mold cavity. As the mold structure 16 is withdrawn from the furnace assembly 12, the solidification front in each of the article molds 20 remains in approximate alignment with the upper edge portion 48 of the solidification control elements 40. In the specific embodiment of the invention illustrated in FIGS. 1 and 2, the chill plate 32 and mold structure 16 are lowered relative to the stationary solidification control elements 40.

It is believed that the use of the solidification control elements 40 may facilitate the obtaining of cellular solidification fronts to between the molten metal in the upper portions of the article mold cavities 52 and solid metal in the lower portions of the article mold cavities. The cellular solidification fronts are maintained in horizontal alignment with the upper end portions 48 of the solidification control elements 40. The cellular solidification fronts are free of dendrites which commonly project from a solidification front during the solidification of molten metal. The absence of dendrites is obtained with cellular solidification fronts due to the relatively high rate of heat transfer from the article molds 20 during a relatively low rate of lowering of the article mold structure 16 from the furnace assembly 12.

When molten metal solidifies with a dendritic solidification front, the dendrites tend to become interconnected with small pockets of molten metal between the dendrites. When this molten metal solidifies, there may be a tendency to form small voids in the metal. This may increase the porosity of the resulting casting. By having cellular solidification fronts between the molten and solid metal, the formation of small voids in the castings formed in the article molds 20 is eliminated or at least minimized. This results in little or no porosity in the resulting casting.

The absence of porosity in a casting enhances the characteristics of the casting and, in certain environments, such as in turbine engines, may be advantageous. The advantages obtained by having a cellular solidification front may be obtained with many different types of crystallographic structures, including equiaxed, columnar and/or single crystal crystallographic structures.

It should be understood that the mold structure 16 may be lowered from the furnace assembly 12 in a manner which results in solidification of the molten metal in the article molds 20 along dendritic solidification fronts. Whether the solidification front is cellular or dendritic, the solidification fronts in the article molds 20 in the array 18 are all disposed adjacent a horizontal plane which is aligned with the upper end portions 48 of the solidification control elements 40. Thus, the solidification fronts in the article molds 20 are all disposed at the same level which moves upward in the article mold cavities 52 as the mold structure 16 is withdrawn from the furnace assembly 12.

Although it is believed that the obtaining of cellular solidification fronts in the article molds 20 may be advantageous, it is contemplated that the speed of withdrawal of the mold structure 16 from the furnace assembly 12 could be such that dendritic solidification fronts are obtained. Regardless of which type of solidification front is obtained, the solidification front in each of the article molds 20 is aligned with the upper edge portions 48 of the solidification control elements 40.

The solidification control elements 40 (FIG. 1) promote rapid cooling to the metal in the article molds 20 adjacent to the upper end portions 48 of the solidification control elements. To promote a relatively high rate of heat transfer from the article molds 20 as they are withdrawn from the furnace assembly 12, the solidification control elements 40 function as heat sinks and as radiation baffles. The relatively rapid cooling of the metal in the article molds 20, as the article molds move downward from the furnace assembly 12 (FIG. 2), enables the solidification fronts in the article mold cavities 52 to be maintained at a level adjacent to the upper end portions 48 of the stationary solidification control elements 40. The high rate of heat transfer is advantageous whether the solidification fronts in the article mold cavities 52 have a cellular or dendritic structure.

To enable the solidification control elements 40 to function as heat sinks, the solidification control elements are formed of metal. The solidification control elements 40 may be cooled by a flow of cold liquid through passages in the solidification control elements. The relatively cold metal of the solidification control elements 40 absorbs and dissipates heat radiated from the article molds 20. If desired the flow of coolant through the metal solidification control elements could be omitted.

Figure 3:
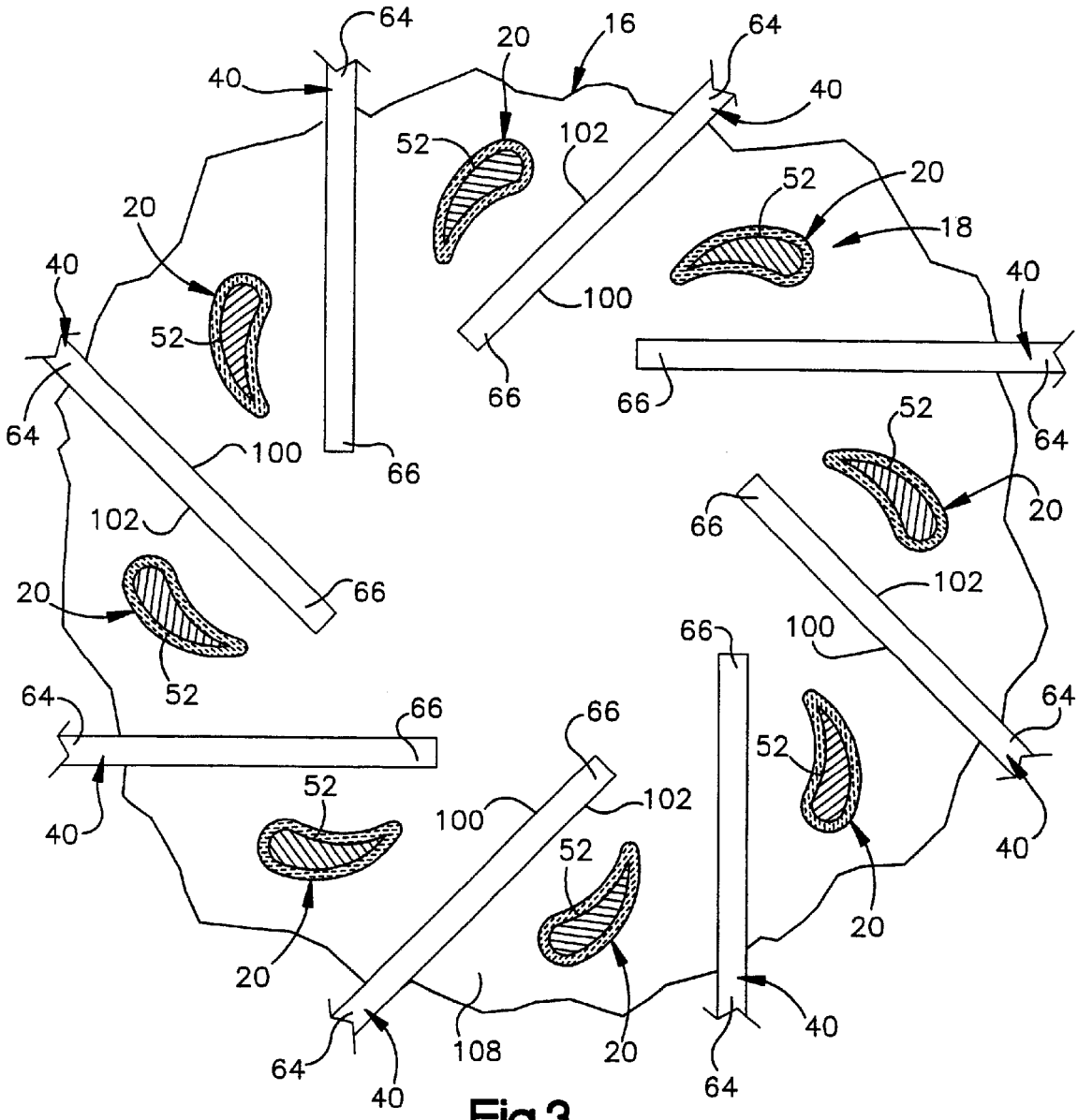
FIG. 3 Is an enlarged fragmentary schematic illustration, taken generally along the line 3—3 of FIG. 2, further depicting the relationship of the solidification control elements to the mold structure.

To enable the solidification control elements 40 to function as radiation baffles, the solidification control elements are positioned between adjacent article molds 20 in the array 18 of article molds (FIG. 3). The solidification control elements 40 are effective to block the transmission of heat, by radiation, between the article molds 20. Rather than functioning as both heat sinks and radiation baffles, the solidification control elements 40 may function primarily as heat sinks. Alternatively, the solidification control elements 40 may function primarily as radiation baffles.

Heat is transferred at a relatively high rate from the article molds 20 to the solidification control elements 40 by radiation. Thus, heat is radiated at a high rate to the cool solidification control elements 40 from the hot article molds 20. The solidification control elements 40 are positioned between adjacent article molds 20 (FIG. 3) so as to block the radiation of heat from one article mold to an adjacent article mold. The solidification control elements 40 also block the radiation of heat from the relatively hot central portion of the mold structure 16 to the article molds 20.

The solidification control elements 40 extend inward from outer end portions located outward of the array 18 of article molds 20 to end portions disposed in a central portion of the array 18 of article molds. Thus, the rectangular solidification control elements 40 have linear outer edge portions 64 (FIG. 1) which are disposed radially outward from the annular array 18 of article molds 20. The solidification control elements 40 have linear inner edge portions 66 which are disposed radially inward (FIG. 3) from the annular array 18 of article molds 20. Thus, each of the solidification control elements 40 extends from the periphery to a central portion of the annular array 18 of article molds 20.

Rather than being separate metal members, the solidification control elements 40 may extend radially outward from a central core disposed in alignment with the center of the chill plate 32. If the solidification control elements 40 are the function as heat sinks, the solidification control elements may be formed of metal cooled by a flow of liquid and/or have dark surfaces which absorb radiation. If the solidification control elements 40 are to function primarily as radiation baffles, they may be formed of a heat resistant material having a relatively poor thermal conductivity, compared to metal. For example, solidification control elements which are to function only as radiation baffles may be formed of a ceramic or graphite, such as "Graphfoil" (trademark). Of course, the metal solidification control elements 40 may be constructed so as to function as both heat sinks and radiation baffles.

During preheating the mold structure 16 and the filling of the of the article molds 20 with molten metal, the mold structure 16 is disposed in the heating chamber 14 of the furnace assembly 12 (FIG. 1). At this time, the solid metal upper end portions 48 of the solidification control elements 40 are disposed within passages 44 in the chill plate 32. Therefore, even though the upper end portions 48 of the solidification control elements 40 are close to the hot heating chamber 14, they are maintained at a relatively low temperature by the chill plate 32 and by a flow of cooling fluid through passages (not shown) disposed in the solidification control elements. This enables the upper end portions 48 of the solidification control elements 40 to remain at a relatively low temperature for a substantial period of time during which the mold structure 16 is in the heating chamber 14.

After the article molds 20 have been filled with molten metal, the mold structure 16 is withdrawn from the furnace assembly 12. This may be accomplished by lowering the chill plate 32. As the chill plate 32 is lowered, the solidification control elements 40 may remain stationary. This results in the upper linear edges of the solidification control elements 40 being disposed adjacent to the lower end portions 56 of the article molds 20 during initial lowering of the mold structure 16.

As the mold structure 16 is initially lowered from the heating chamber 14, the molten metal in the article molds 20 begins to solidify at the lower end portions 56 of the article molds 20. This solidification of the molten metal occurs at solidification fronts which are disposed at the same level in each of the article molds 20. The solidification fronts in the article molds 20 are disposed in alignment with the linear upper edges of the solidification control elements 40.

Since the cold solidification control elements 40 are disposed adjacent to the hot article molds 20, there is a relatively high rate of heat transfer between the article molds and the solidification control elements. In addition, the solidification control elements 40 are effective to block the radiation of heat between adjacent article molds 20 at levels below the upper edge portions 48 of the solidification control elements.

As the chill plate 32 and mold structure 16 continues to be lowered relative to the solidification control elements 40, the solidification fronts in the article molds 20 move upward from the lower end portions 56 of the article molds towards the upper end portions 58 of the article molds. The solidification fronts in the article molds 20 remain in a horizontal plane which extends through the upper end portion 48 of the solidification control elements 40. Therefore, the solidification fronts remain stationary in alignment with the upper end portions 48 of the stationary solidification control elements 40 as the article molds 20 are lowered.

Continued downward movement of the chill plate 32 and mold structure 16 results in the upper end portions 48 of the stationary solidification control elements 40 being closely adjacent to the upper end portions 58 of the downwardly moving article molds 20. In the embodiment of the invention illustrated in FIG. 16, the gating system 28 is provided with a plurality of passages which are aligned with the passages 44 in the chill plate 32. As the mold structure 16 and chill plate 32 continue to move downward, the upper edge portions 48 of the solidification control elements 40 move into and through the passages in the gating system 28.

When the molten metal in the article mold cavities 52 completely solidified, the mold structure 16 can be rapidly lowered. As this occurs, the chill plate 32 moves below lower edge portions of the rectangular solidification control elements 40. In addition, the entire mold structure 16 moves below the stationary solidification control elements 40. This enables the mold structure 16 to be moved off of the chill plate 32 and a next succeeding mold structure to be positioned on the chill plate.

Figure 2:
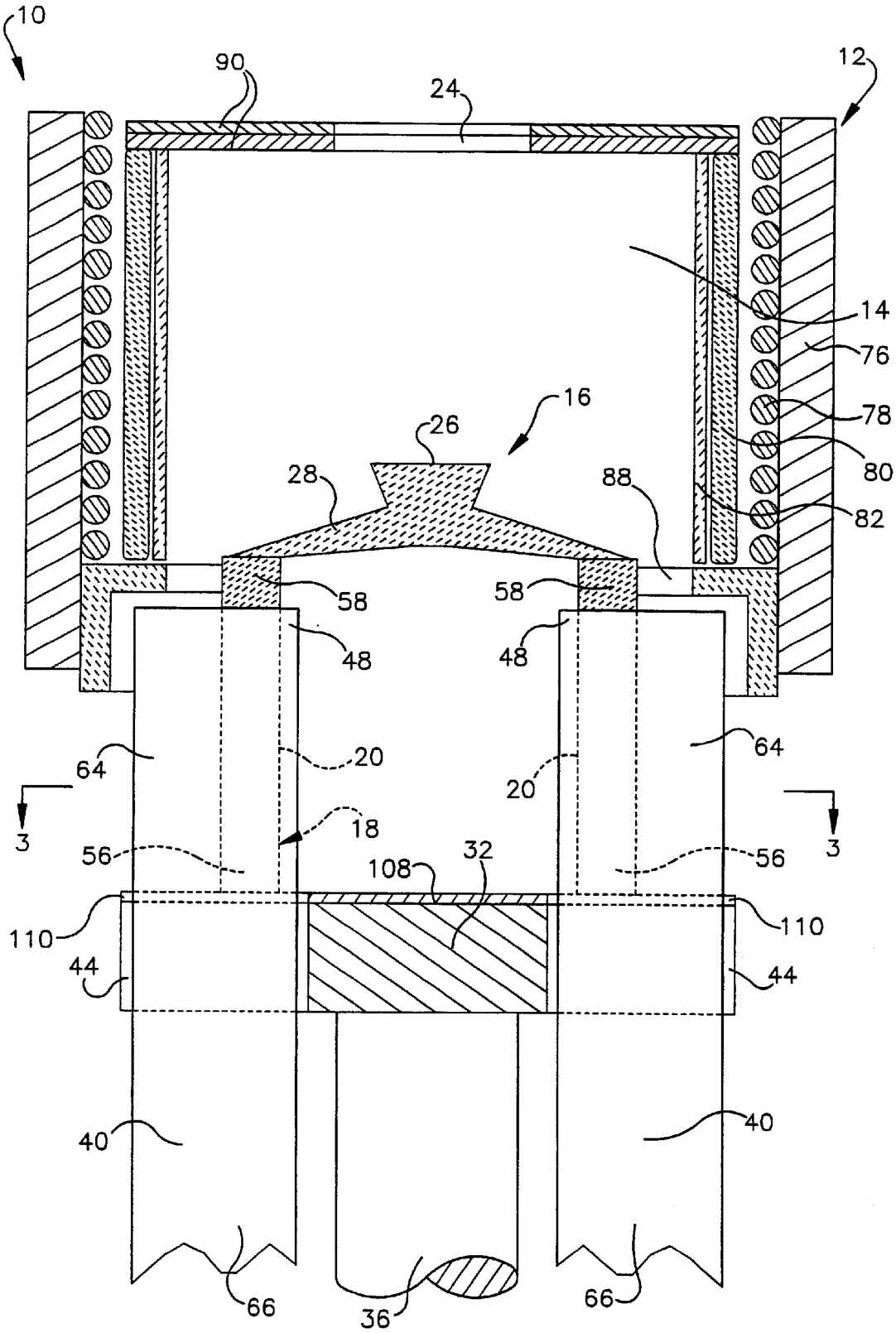
FIG. 2 Is a schematic illustration, generally similar to FIG. 1, depicting the relationship between the mold structure and solidification control elements during withdrawal of the mold structure from the heating chamber of the furnace assembly.

In the embodiment of the invention illustrated in FIGS. 1–3, the solidification control elements 40 and furnace assembly 12 are stationary. However, it is contemplated the furnace assembly and/or solidification control elements 40 could be moved. For example, the furnace assembly 12 and solidification control elements 40 could be raised relative to a stationary mold structure 16 and chill plate 32.

It is contemplated that the solidification control elements 40 could be moved radially inward toward the circular array 18 of article molds 20. It is also contemplated that the mold structure 16 could be suspended from above and lowered relative to the furnace assembly 12 and solidification control elements 40 without being supported on a chill plate corresponding to the chill plate 32. This would enable the chill plate 32 to be eliminated.

Furnace Assembly

The furnace assembly 12 has a known construction which may be similar to the construction of the furnace assembly disclosed in U.S Pat. No. 3,841,384 and/or U.S. Pat. No. 5,046,547. The furnace assembly 12 includes a cylindrical outer wall 76. The outer wall 76 extends around circular turns of an induction coil 78. The induction coil 78 is disposed between the outer wall 76 and a cylindrical graphite insulating layer 80. A cylindrical susceptor wall 82 is disposed inside insulating layer 80.

An annular ceramic base or Cambridge ring 86 is disposed at a lower end portion of the furnace assembly 12 and defines a circular opening 88 to the heating chamber 14. Circular graphite cover panels 90 close an upper end portion of the heating chamber 14 and define the opening 24 through which molten metal is poured into the mold structure 16. The entire furnace assembly 12 may be enclosed in a housing which is evacuated in a known matter during pouring of molten metal into the mold structure 16.

If the mold structure 16 is to be suspended rather than supported on the chill plate 32, a relatively large opening 24 may be provided at the upper end portion of the furnace assembly 12 to enable the mold structure 16 to be lowered into the furnace assembly. If this is done, the mold structure 16 may be moved downward from the furnace assembly 12. The suspended mold structure 16 may be lowered onto the chill plate 32. However, suspending the mold structure 16 eliminates the need to support the mold structure on the chill plate.

The solidification control elements 40 may be moved radially inward, relative to the furnace assembly 12, contemporaneously with lowering of the mold structure 16. If this is done, the upper edge portions 48 of the solidification control elements 40 would be moved into alignment with the lower end portions 56 of the mold structure 16 as the mold structure is lowered from the furnace. During continued lowering of the mold structure from the furnace, the mold structure would move along the solidification control elements in the manner previously described herein. If desired, the solidification control elements 40 could be enclosed by a fluidized bed. The fluidized bed may be formed in the manner disclosed in U.S. patent application Ser. No. 09/569,906 filed May 11, 2000 by Graham et al and entitled SYSTEM FOR CASTING A METAL ARTICLE USING A FLUIDIZED BED. The mold structure 16 may be suspended in the manner disclosed in the aforementioned application Serial No. 09/569,906 filed May 11, 2000 by Graham et al. The disclosure in the aforementioned U.S. patent application Ser. No. 09/569,906 filed May 11, 2000 by Graham et al is hereby incorporated herein in its entirety by this reference thereto.

Solidification Control Elements

The solidification control elements 40 function as heat sinks which absorb and dissipate heat radiated from the article molds 20. By having a high rate of absorption of heat radiated from the article molds 20 by the solidification control elements 40 and by having a high rate of heat conduction through the solidification control elements 20 to locations spaced from the article molds 20, the solidification control elements function as heat sinks for the article molds.

The solidification control elements 40 are effective to conduct heat away from the article molds 20. The solidification control elements 40 also function as radiation baffles which block the radiant transmission of heat between adjacent article molds 20. The solidification control elements 40 also block the radiant transmission of heat between the central portion of the annular array 18 of article molds and the individual article molds 20.

The solidification control elements 40 promote uniform cooling of the article molds 20 as the mold structure 16 is withdrawn from the furnace assembly 12. In the absence of the solidification control elements 40, the periphery of the annular array 18 of article molds 20 cools at a faster rate than the interior or central portion of the annular array of article molds. This is because the periphery of the annular array 18 of article molds 20 is exposed to the relatively cold environment outside of the furnace assembly 12. The central portion of the annular array 18 of article molds 20 is open so that the hot article molds 20 are exposed to each other, to the hot gating system 28 and to the hot interior of the furnace assembly 12. Therefore, the peripheral portion of the mold structure 16 would cool faster than the interior portion of the mold structure when the mold structure is withdrawn from the furnace assembly without the solidification control elements 40.

The solidification control elements 40 are formed of solid metal. If desired, the solidification control elements 40 may have internal cooling passages through which a liquid cooling is circulated. A liquid coolant which is circulated through the solidification control elements 40 may be the same as is circulated through the cooling passages in the chill plate 32. If desired, a single coolant circulation pump may be utilized to pump coolant through passages in the solidification control elements 40 and in the chill plate 32. Of course, separate coolant pumps could be utilized if desired. Of course, the solidification control elements 40 may be formed as solid pieces of metal without cooling passages.

The conduction of heat through the solidification control elements 40 is effective to maintain the solidification control elements at a temperature which is substantially lower than the temperature of the article molds 20. Therefore, as the article molds 20 are lowered from the heating chamber 14, heat is radiated from the relatively hot article molds 20 to the solidification control elements 40 in the manner indicated schematically by arrows in FIG. 4. The relatively cool solidification control elements 40 absorb the heat radiated from the relatively hot article molds 20. This heat is conducted through the solidification control elements 40 to lower end portions of the solidification control elements 40. Therefore, the metal solidification control elements 40 remain relatively cool as the article molds 20 are withdrawn from the heating chamber 14 and are cooled by the transmission of heat to the solidification control elements.

In order to maximize the absorption of heat by the solidification control elements 40, the distance between the solidification control elements and the article molds 20 may be reduced. This may be done by increasing the width of the solidification control elements 40. Thus, the distance between parallel rectangular major side surfaces 100 and 102 of the solidification control elements 40 may be increased. This would reduce the distance between the side surfaces 100 and 102 of the solidification control elements 40 and the article molds 20.

The illustrated solidification control elements 40 have flat major side surfaces 100 and 102. However, it is contemplated that the major side surfaces 100 and 102 of the solidification control elements may be curved so as to facilitate enclosing the article molds 20 with the solidification control elements. Of course, if this was done, the shape of the passages 44 in the chill pate 32 would correspond to the curving configuration of the side surfaces 100 and 102 of the solidification control elements 40. It is also contemplated that the solidification control elements 40 may be provided with flanges at the ends and/or edge portions 64 and 66 of the solidification control elements. Projections or flanges may also be provided at central portions of the solidification control elements 40. Alternatively, the distance between the solidification control elements 40 and the article molds 20 may be decreased by decreasing the distance between adjacent article molds 20 in the array of article molds 18 or by providing additional solidification control elements 40.

The solidification control elements 40 function as radiation baffles to block the transmission of radiant heat from one article mold 20 to a next adjacent mold. In addition, the solidification control elements 40 block the radiation of heat to or from article molds 20 disposed more or less diametrically across the annular array 18 of article molds. Thus, heat radiated from one side of an article mold 20 is blocked from being transmitted to an adjacent article mold by a major side surface 100 on a solidification control element 40. The radiation of heat from the opposite side of the article mold 20 to adjacent article mold is blocked by the major side surface 102 of a solidification control element 40. Therefore, heat cannot be transmitted by radiation between article molds 20 in the array 18 of article molds as the mold structure 16 is lowered from the heating chamber 14. If desired, the configuration of the solidification control elements can be changed from the illustrated rectangular configuration to more completely enclosed the article molds 20 with the solidification control elements 40 and minimize the amount of radiant heat which can be transmitted around the solidification control elements.

Figure 4:
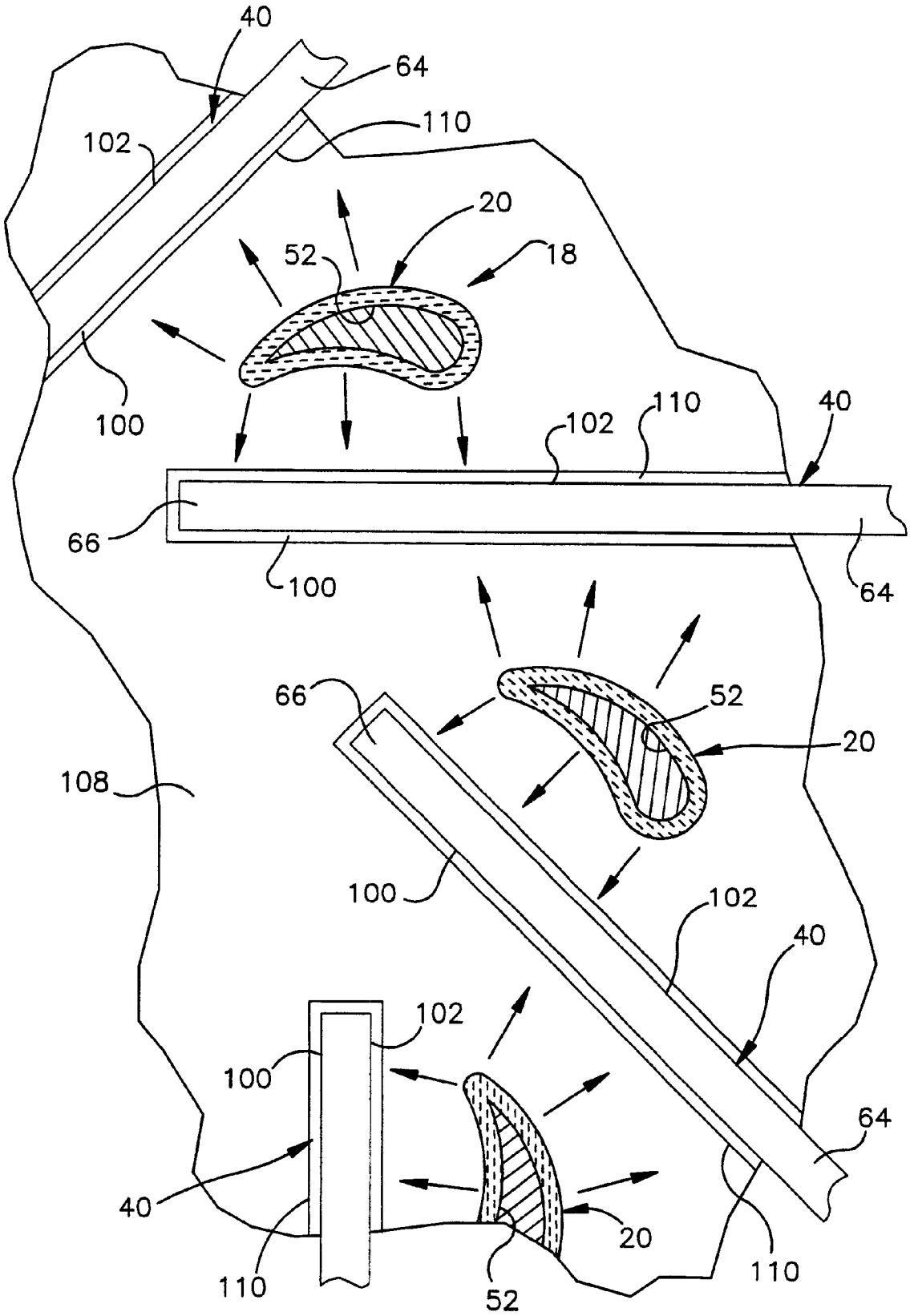
FIG. 4 Is an enlarged schematic illustration of a portion of FIG. 3.

The mold structure 16 has a circular base plate 108 (FIGS. 1 and 4). The article molds 20 are connected with and extend upward from the base plate 108 to the gating system 28. To accommodate the solidification control elements 40, the base plate 108 is provided with a plurality of slots 110 (FIG. 4) which are aligned with and have the same configuration as the passages 44 (FIG. 1) and the chill plate 32. However, the passages 110 in the base plate 108 (FIG. 4) are slightly larger than the slots 44 in the chill plate 32. The slots 110 in the base plate 108 are aligned with similarly shaped slots formed in the gating system 28 (FIG. 1) to enable the mold structure 16 to be lowered downward past the solidification control elements 40.

Operation

When articles, such as airfoils for a turbine engine, are to be cast in the article molds 20, the chill plate 32 is lowered to a position beneath lower edge portions of the solidification control elements. The mold structure 16 is positioned on the chill plate 32. The slots 110 in the base plate 108 of the mold structure 16 are aligned with the slots 44 in the chill plate 32. In the embodiment of the invention illustrated in FIGS. 1–4, the solidification control elements 40 are skewed at acute angles relative to radial planes extending through the chill plate 32. However, if desired, the solidification control elements 40 could be aligned with radial planes extending through the chill plate 32.

Once the mold structure 16 has been positioned on the chill plate 32, the motor 34 is operated to raise the chill plate and the mold structure toward the furnace assembly 12. As this occurs, lower ends of the solidification control elements 40 move into the slots in the gating system 28. Continued upward movement of the chill plate 32 results in the lower ends of the solidification control elements moving through the slots 110 in the base 108 of the mold structure 16 into the passages 44 in the chill plate 32. As the chill plate 32 moves further upward, the upper end portions 48 of the solidification control elements 40 move into the chill plate passages 44. The mold structure 16 is then in the position illustrated in FIG. 1.

When the mold structure 16 has moved into the heating chamber. 14 in the furnace assembly 12 (FIG. 1), operation of the motor 34 and upward movement of the chill plate 32 are interrupted. The furnace assembly 12 is then operated in a known matter to preheat the mold structure 16 to a desired temperature. As the mold structure 16 is preheated, the chill plate 32 cools the upper and portions 48 of the solidification control elements 40. Once the mold structure 16 has been preheated to a desired temperature, molten metal is poured through the opening 24 in the cover panel 90 into the mold structure.

The molten metal flows from the pour cup 26 through the gating system 28 into the article molds 20. The article molds 20 are filled with molten metal. Once the article molds 20 have been filled with molten metal, pouring of the molten metal into the mold structure 16 is interrupted.

The motor 34 is then operated to lower the chill plate 32 and mold structure 16 relative to the stationary solidification control elements 40. Rather than lowering the chill plate 32 and mold structure 16, the furnace assembly 12 and solidification control elements 40 could be raised relative to the stationary chill plate 32 and mold structure if desired.

During the initial of the lowering of the chill plate 32 and mold structure 16, the lower end portions 56 of the article molds 20 move downward into alignment with the upper end portions 48 of the solidification control elements 40. As this occurs, the molten metal in the lower end portions 56 of the article molds solidifies.

The molten metal in each article mold 20 solidifies at a solidification front. The solidification fronts in the article molds 20 are all at the same level above the chill plate 32. As the mold structure 16 is lowered, the solidification fronts in the article molds 20 remain stationary in alignment with the upper end portions 48 of the stationary solidification control elements 40. Therefore, as the mold structure 16 is lowered, the stationary solidification fronts in the article molds 20 are displaced away from the lower end portions 56 of the article molds toward the upper end portions 58 of the article molds.

During withdrawal of the mold structure 16 from the heating chamber, the solidification control elements 40 are disposed between adjacent article molds 20 in the annular array 18 of article molds. It should be understood that the article molds 20 could be arranged in an array having a configuration other than the annular configuration of array 18.

The solidification control elements 40 absorb heat transmitted from the article molds 20 and block radiation of heat between the article molds. Therefore, the solidification control elements promote solidification of the molten metal in the article molds along fronts which remain in alignment with the upper end portions 48 of the solidification control elements 40.

As the mold structure 16 continues to be withdrawn from the heating chamber 14, the upper end portions 48 of the solidification control elements 40 enter slots in the gating system 28. Continued downward movement of the mold structure 16 moves the gating system 28 to a level below the lower end portions of the solidification control elements 20. The mold structure 16, with the solid metal in the article molds 20, is then removed from the chill plate 32.

Conclusion

From the foregoing description, it is apparent that the present invention relates to the present invention provides a new and improved method and apparatus for use in casting a plurality of metal articles. The method includes filling article molds 20 with molten metal. The molten metal may be solidified in the article molds 20 with a plurality of solidification control elements 40 extending between a peripheral portion of the array 18 of article molds and a central portion of the array of article molds.

The solidification control elements 40 may function as heat sinks and/or radiation baffles. The solidification control elements 40 may have upper end portions 48 which are maintained adjacent to solidification fronts in the article molds 20 during solidification of molten metal in the article molds. The solidification control elements 40 may extend through passages 44 in the chill plate 32 during at least a portion of the solidification of molten metal.

It is contemplated that various features of the present invention may be utilized separately or in combination with other features of the invention. Alternatively, each of the various features of the present invention may be used in association with known prior art features.

Having described the invention, the following is claimed:

1. A method of casting a plurality of metal articles, said method comprising the steps of providing an array of article molds, filling the article molds with molten metal, and solidifying at least a portion of the molten metal in the article molds with a plurality of heat sinks extending between a peripheral portion of the array of article molds and a central portion of the array of article molds.

2. A method as set forth claim 1 further including the step of providing relative movement between the heat sinks and article molds to change locations of the heat sinks relative to the array of article molds from locations spaced from the array of article molds to locations in which the heat sinks extend between the peripheral portion and the central portion of the array of article molds.

3. A method as set forth in claim 2 wherein said step of providing relative movement between the heat sinks and article molds includes moving the article molds relative to the heat sinks.

4. A method as set forth in claim 2 wherein said step of providing relative movement between the heat sinks and article molds includes providing relative movement in an axial direction relative to an annular array of article molds.

5. A method as set forth in claim 1 further including the step of providing relative movement between the plurality of heat sinks and the array article molds, said step of providing relative movement between the heat sinks and the array of article molds includes providing relative movement between each one of the heat sinks and the array of article molds along a path extending through the one heat sink and array of article molds at a location disposed between adjacent article molds in the array of article molds.

6. A method as set forth in claim 1 further including the step of providing relative movement between the plurality of heat sinks and the array of article molds between a first relationship in which the plurality of heat sinks are spaced from the array of article molds and a second relationship in which the plurality of heat sinks extend into the array of article molds, said step of filling the article molds with molten metal being at least partially formed with the plurality of heat sinks and the article molds in the first relationship, said step of solidifying molten metal in the article molds being at least partially performed with the plurality of heat sinks and the article molds in the second relationship.

7. A method as set forth in claim 1 wherein the plurality of heat sinks are disposed in an annular array having a central axis which is aligned with a central axis of an annular array of article molds, said method includes providing axial movement between the annular array of heat sinks and the annular array of article molds.

8. A method as set forth in claim 1 wherein said step of filling the article molds with molten metal is performed with the array of article molds supported by a chill plate and with the plurality of heat sinks spaced from the array of article molds, said method includes moving the chill plate and the array of article molds relative to the plurality of heat sinks during solidification of at least a portion of the molten metal in the article molds.

9. A method as set forth in claim 1 further including the step of lowering the array of article molds from a first position in which the plurality of heat sinks are disposed below the array of article molds to a second position in which the plurality of heat sinks extend into the array of article molds.

10. A method as set forth in claim 1 further including the steps of providing a chill plate having a plurality of passages extending through the chill plate, supporting the array of article molds with the chill plate during filling of the article molds with molten metal, and lowering the chill plate with the heat sinks of the plurality of heat sinks extending into the plurality of passages in the chill plate.

11. A method as set forth in claim 1 further including the step of at least partially blocking radiant transmission of heat between adjacent article molds in the array of article molds with the plurality of heat sinks.

12. A method as set forth in claim 1 further including the step of increasing an extent to which the heat sinks extend along the article molds by providing relative movement between the heat sinks and article molds.

13. A method as set forth in claim 1 further including the step of increasing the extent of a side-by-side relationship between the heat sinks and the article molds by providing relative movement between the heat sinks and article molds with the heat sinks at least partially disposed between adjacent article molds in the array of article molds.

14. A method as set forth in claim 13 wherein said step of increasing the extent of a side-by-side relationship between the heat sinks and the article molds by providing relative movement between the heat sinks and article molds includes increasing a vertical extent of the side-by-side relationship between the heat sinks and the article molds.

15. A method as set forth in claim 1 wherein said step of solidifying molten metal in the article molds includes moving solidification fronts between molten metal and solid metal in the article molds from lower end portions to upper end portions of the article molds, said method includes maintaining upper end portions of the heat sinks adjacent to the solidification fronts in the article molds during solidification of the molten metal in the article molds.

16. A method of casting a plurality of metal articles, said method comprising the steps of providing an array of article molds, filling the article molds with molten metal, and solidifying at least a portion of the molten metal in the article molds with a plurality of radiation baffles extending between a peripheral portion of the array of article molds and a central portion of the array of article molds to at least partially block radiant transmission of heat between adjacent molds in the array of article molds with the radiation baffles.

17. A method as set forth in claim 16 further including the step of providing relative movement between the radiation baffles and article molds to change locations of the radiation baffles relative to the array of article molds from locations spaced from the array of article molds to locations in which the radiation baffles extend between the peripheral portion and the central portion of the array of article molds.

18. A method as set forth in claim 17 wherein said step of providing relative movement between the radiation baffles and article molds includes moving the article molds relative to the radiation baffles.

19. A method as set forth in claim 17 wherein said step of providing relative movement between the radiation baffles and the article molds includes providing relative movement in an axial direction relative to an annular array of article molds.

20. A method as set forth in claim 16 further including the step of providing relative movement between the plurality of radiation baffles and the array of article molds, said step of providing relative movement between the radiation baffles and the array of article molds includes providing relative movement between each one of the radiation baffles and the array of article molds along a path extending through the one radiation baffle and the array of article molds at a location disposed between adjacent article molds in the array of article molds.

21. A method as set forth in claim 16 further including the step of providing relative movement between the plurality of radiation baffles and the array of article molds between a first relationship in which the plurality of radiation baffles are spaced from the array of article molds and a second relationship in which the plurality of radiation baffles extend into the array of article molds, said step of filling the article molds with molten metal being at least partially performed with the plurality of radiation baffles and the article molds in the first relationship, said step of solidifying molten metal in the article molds is performed with the plurality of radiation baffles and the article molds in the second relationship.

22. A method as set forth in claim 16 wherein the plurality of radiation baffles are disposed in an annular array having a central axis which is aligned with a central axis of an annular array of article molds, said method includes providing axial movement between the annular array of radiation baffles and the annular array of article molds.

23. A method as set forth in claim 16 wherein said step of filling the article molds with molten metal is performed with the array of article molds supported by a chill plate with the plurality of radiation baffles spaced from the array of article molds, said method includes moving the chill plate and the array of article molds relative to the plurality of radiation baffles during solidification of at least a portion of the molten metal in the article molds.

24. A method as set forth in claim 16 further including the step of lowering the array of article molds from a first position in which the plurality of radiation baffles are disposed below the array of article molds to a second position in which the plurality of radiation baffles extend into the array of article molds.

25. A method as set forth in claim 16 further including the step of providing a chill plate having a plurality of passages extending through the chill plate, supporting the array of article molds with the chill plate during filling of the article molds with molten metal, and lowering the chill plate with the radiation baffles of the plurality of radiation baffles extending into the plurality of passages in the chill plate.

26. A method as set forth in claim 16 further including the step of absorbing heat transmitted from the article molds with the radiation baffles of the plurality of radiation baffles.

27. A method as set forth in claim 16 further including the step of increasing an extent to which the radiation baffles extend along the article molds by providing relative movement between the radiation baffles and article molds.

28. A method as set forth in claim 16 further including the step of increasing the extent of a side-by-side relationship between the radiation baffles and the article molds by providing relative movement between the radiation baffles and article molds with the radiation baffles at least partially disposed between adjacent article molds in the array of the article molds.

29. A method as set forth in claim 26 wherein said step of increasing the extent of a side-by-side relationship between the radiation baffles and the article molds by providing relative movement between the radiation baffles and article molds includes increasing a vertical extent of the side-by-side relationship between the radiation baffles and the article molds.

30. A method as set forth in claim 16 wherein said step of solidifying molten metal in the article molds includes moving solidification fronts between molten metal and solid metal in the article molds from lower end portions to upper end portions of the article molds, said method includes maintaining upper end portions of the radiation baffles adjacent to the solidification fronts in the article molds during solidification of the molten metal in the article molds.

31. A method of casting a plurality of metal articles, said method comprising the steps of supporting an array of article molds with a chill plate, filling the article molds in the array with molten metal, and providing relative movement between the chill plate and a plurality of heat sinks, said step of providing relative movement between the chill plate and the plurality of heat sinks is at least partially performed with the plurality of heat sinks extending through passages in the chill plate into the array of article molds at locations between adjacent article molds in the array of article molds.

32. A method as set forth in claim 31 wherein said step of providing relative movement between the chill plate and the plurality of heat sinks includes lowering the chill plate relative to the plurality of heat sinks.

33. A method as set forth in claim 31 wherein said step of providing relative movement between the chill plate and the plurality of heat sinks is at least partially performed with the plurality of heat sinks extending between a peripheral portion of the array of article molds and a central portion of the array of article molds.

34. A method as set forth in claim 31 further including the step of at least partially blocking radiant transmission of heat between adjacent article molds in the array of article molds with the plurality of heat sinks.

35. A method of casting a plurality of metal articles, said method comprising the steps of supporting an array of article molds with a chill plate, filling the article molds in the array with molten metal, and providing relative movement between the chill plate and a plurality of radiation baffles, said step of providing relative movement between the chill plate and the plurality of radiation baffles is at least partially performed with the plurality of radiation baffles extending through passages in the chill plate into the array of article molds at locations between adjacent article molds in the array of article molds.

36. A method as set forth in claim 35 wherein said step of providing relative movement between the chill plate and the plurality of radiation baffles includes lowering the chill plate relative to the plurality of radiation baffles.

37. A method as set forth in claim 35 wherein said step of providing relative movement between the chill plate and the plurality of radiation baffles in at least partially performed with the plurality of radiation baffles extending between a peripheral portion of the array of article molds and a central portion of the array of article molds.

38. A method as set forth in claim 35 further including the step of absorbing heat transmitted from article molds with the radiation baffles of the plurality of radiation baffles.

39. A method of casting a plurality of metal articles, said method comprising the steps of providing a plurality of article molds, filling the article molds with molten metal, solidifying molten metal in the article molds, said step of solidifying the molten metal in the article molds includes moving solidification fronts between molten metal and solid metal in the article molds from lower end portions to upper end portions of the article molds, and maintaining upper end portions of solidification control elements adjacent to the solidification fronts with major side surfaces of the solidification control elements disposed between adjacent article molds and extending downward from the upper edge portions of the solidification control elements during solidification of at least a portion of the molten metal in the article molds.

40. A method as set forth in claim 39 wherein the plurality of article molds are disposed in an annular array, said step of solidifying the molten metal in the article molds is at least partially performed with the solidification control elements extending between a peripheral portion of the annular array of article molds and a central portion of the annular array of article molds.

41. A method set forth in claim 39 wherein said step of maintaining upper end portions of the solidification central elements adjacent to solidification fronts includes providing relative movement between the solidification control elements and article molds.

42. A method as set forth in claim 41 wherein said step of providing relative movement between the solidification control elements and the article molds includes changing locations of the solidification control elements relative to the article molds from locations spaced from an array formed by the article molds to locations in which the solidification control elements extend into the array formed by the article molds.

43. A method as set forth in claim 39 wherein said step of maintaining upper end portions of the solidification control elements adjacent to the solidification fronts includes moving the article molds relative to the solidification control elements.

44. A method as set forth in claim 39 wherein said step of maintaining upper end portions of the solidification control elements adjacent to the solidification fronts includes providing relative movement between an array formed by the article molds and an array formed by the solidification control elements along an axis extending through the array of article molds and through the array of solidification control elements.

45. A method as set forth in claim 39 further including the step of providing relative movement between the article molds and solidification control elements from a first relationship in which the solidification control elements are spaced from an array formed by the article molds and a second relationship in which the solidification control elements extend into the array of article molds, said step of maintaining the upper end portions of the solidification control elements adjacent to the solidification fronts includes increasing the extent to which the solidification control elements extend into the array of article molds.

46. A method as set forth in claim 39 wherein the article molds are disposed in an annular array and the solidification control elements are disposed in an annular array having a central axis which is aligned with a central axis of the annular array of article molds, said step of maintaining upper end portions of the solidification control elements adjacent to the solidification fronts includes providing axial movement between the annular array of solidification control elements and the annular array of article molds.

47. A method as set forth in claim 39 further including the steps of providing a chill plate having a plurality of passages extending through the chill plate, supporting the article molds with the chill plate during filling of the article molds with molten metal, said step of maintaining upper end portions of the solidification control elements adjacent to the solidification fronts includes lowering the chill plate with the solidification control elements extending into the passages in the chill plate.

48. A method as set forth in claim 39 further including the step of at least partially blocking radiant transmission of heat between portions of the article molds disposed below the solidification fronts with the solidification control elements.

49. A method as set forth in claim 39 further including the step of absorbing heat transmitted from the article molds with the solidification control elements.

* * * * *